US005143170A

United States Patent [19]

Hunt et al.

[11] Patent Number: 5,143,170

[45] Date of Patent: Sep. 1, 1992

[54] SAFETY DEVICE FOR ROOF WORK

[76] Inventors: Don Hunt, 442 Cove Dr., Marietta, Ga. 30067; Jimmy R. Howard, P.O. Box 143, Felton, Ga. 30140

[21] Appl. No.: 783,395

[22] Filed: Oct. 28, 1991

[51] Int. Cl.[5] ..... A62B 35/00

[52] U.S. Cl. ..... 182/3; 182/45; 248/237

[58] Field of Search ..... 182/3–8, 182/45, 142; 248/237

[56] References Cited

U.S. PATENT DOCUMENTS

| | | | |
|---|---|---|---|
| 822,658 | 6/1906 | Emberson | 248/237 |
| 2,275,014 | 3/1942 | Hahler | 248/237 |
| 3,237,717 | 3/1966 | Jackson | 182/45 |
| 4,398,620 | 8/1983 | Townsend | 182/4.5 |
| 4,406,351 | 9/1983 | Littlejohn | 182/142 |
| 4,606,430 | 8/1986 | Roby | 182/3 |
| 4,699,245 | 10/1987 | Benedet | 182/3 |
| 4,785,606 | 11/1988 | Burton | 52/749 |
| 4,860,518 | 8/1989 | Kingham | 52/748 |
| 4,884,775 | 12/1989 | Fischer, Jr. | 248/237 |
| 4,972,922 | 11/1990 | Levine | 182/45 |
| 5,036,949 | 8/1991 | Crocker | 182/3 |
| 5,054,576 | 10/1991 | Glynn | 182/3 |

FOREIGN PATENT DOCUMENTS

| | | | |
|---|---|---|---|
| 3728282 | 3/1988 | Fed. Rep. of Germany | 182/3 |

*Primary Examiner*—Reinaldo P. Machado

[57] ABSTRACT

A mated pair of sleeper bars (34) comprises a first bar (25) having one end (28') thereof notched to form two fingers (29') and three slots (31'), while one end of the second bar (25) is notched to form three (29) fingers and two slots (31), with the fingers (29) of one bar (25) adapted to fit within the slots (31') of the other bar (25'). The mating fingers (29 and 29') and slots (31 and 31') are drilled for insertion of a connecting pin (37) for pivotally locking the matched ends (28 and 28') of the sleeper bars (25 and 25') together. A plurality of compartments (42) are formed along the length of each sleeper bar (25 and 25'), each compartment (42) being adapted to receive and hold a container (44) filled with a fluid material.

10 Claims, 4 Drawing Sheets

| ROOF PITCH | EXAMPLE 1 6/12 | EXAMPLE 2 5/12 | EXAMPLE 3 4/12 |
|---|---|---|---|
| ROOF ANGLE (β) | 63.43° | 67.38° | 71.34° |
| SAFETYLINE ANGLE (γ) | 3.8° | 7.0° | 11.0° |
| HORIZONTAL FORCE (X) | 120.0# | 144.0# | 180.0# |
| VERTICAL FORCE (Y) | 5.234# | 12.187# | 19.081# |
| RESULTANT FORCE (R) | 152.13# | 146.54# | 140.84# |
| RESULTANT FORCE ANGLE (θ) | 48.97° | 47.36° | 45.82° |

SAFETY DEVICE FOR ROOF WORK

FIELD OF THE INVENTION

The present invention relates in general to a safety device for supporting a worker on a sloped surface. More particularly, the present invention relates to a safety device that is positioned over the peak of a pitched roof without having to be attached to the roof and which supports and secures a worker during movement over the sloped surfaces of the roof.

BACKGROUND OF THE INVENTION

In the construction and repair of pitched roofs, as are commonly found on residential buildings, the workers must have some type of support device to support them and ensure their safety as they move about the roof surface. For work on a conventional pitched roof having fiberglass shingles, for example, the common practice among roofers is to nail a 2"×4" board to the roof to act as a foothold. Such a support is simple and easy to install and remove. However, the range of movement of the worker is limited by the length of the board, and the 2 inch width of the board provides only a limited area for supporting the worker. Thus, if the worker makes even a small misstep, he might slip and fall from the roof. Additionally, driving nails through the roof to secure the boards creates holes therein that allow moisture to leak through the roof once the boards are removed. In the cases of slate or tile roofs, nails cannot be used as a securing means.

Scaffolding systems have been developed for supporting workers on the sloped surfaces of pitched roofs without puncture damage to the shingles or roof. Examples of such conventional scaffolding systems are shown in U.S. Pat. Nos. 4,398,620 of Townsend, 4,860,518 of Kingham, and 4,972,922 of Levine. As illustrated in these patents, conventional prior art scaffolding systems typically include a platform or ladder supported by hooks or angle irons that hook over the peak of the roof and engage the roof cap. The problem with such systems is that they concentrate a large pulling force in a small area directly on the roof cap. The combined weight of the scaffolding, materials, and workers pulls on the roof cap, which can result in shingles being pulled free or the roof structure itself being damaged. Also, certain types of roofing materials such as tile and slate are not able to withstand readily the high stresses resulting from the concentrated weight of these scaffolding systems and, consequently, are likely to crack or break under the stresses. As a result, this conventional scaffolding frequently cannot be used to work on slate or tile roofs, or other roofs made of similar materials. On the other hand, where the apparatus is designed to prevent damage to the roof cap, the force distribution can be such that the scaffolding may, under certain conditions, actually lift away from the roof, with potentially dangerous consequences.

Additionally, the freedom of movement of the worker over the roof surface is limited by the size of the scaffolding and its position on the roof surface. Thus, to move to the next area of the roof, the workers must stop working and move the scaffold platform to a new location, and, if a ladder is in use, must physically pick up and move the ladder to a new location. Such a relocation of the scaffolding is often difficult and dangerous to perform, since these prior art scaffolding systems are bulky and heavy and the workers are on a slanted surface well above the ground, which makes it extremely difficult to pick up, move, and install the scaffolding about the roof surface. Also, if the worker does not properly secure the hooks of the scaffolding in place, after moving it to a new location, there is a danger that the weight of the scaffolding, for instance, will pull the supporting hooks free, causing the scaffolding to shift or even fall from the roof.

Accordingly, it can be seen that a need exists for a support system for supporting and enabling freedom of safe movement of workers over the sloped surfaces of a pitched roof which does not engage or pull on the cap of the roof so as to avoid damage thereto, and wherein the system is easy to install and relocate over the roof.

SUMMARY OF THE INVENTION

Briefly described, the present invention comprises mating interlocked sleeper bars positioned over the peak or cap of the roof, straddling the peak of the roof. The sleeper bars are generally rectangularly shaped beams, each having notched ends that mate with the notched ends of another sleeper bar for pivotally locking the sleeper bars together in pairs. Once locked together, the sleeper bars are positioned on opposite sides of and straddle the roof peak. The pivotal connection for the sleeper bars is centered over the roof cap, and the sleeper bars lie flat against the roof surface without gripping the roof surfaces or cap, or concentrating forces in a small area.

A series of one or more compartments are formed along the length of each sleeper bar. Each compartment is generally rectangularly shaped and is adapted to receive and hold a rectangularly shaped container. Each container is capable of being filled with a fluid medium such as water or even sand or gravel. The filled containers act as a stabilizing means to hold the sleeper bars against the sloped surfaces of the pitched roof and to prevent the sleeper bars from being pulled up and away from the roof surface by the weight of the workers as the workers move about the roof surface.

A safety line such as a rope or cable can be attached by a connecting means, such as a spring loaded slip-hook or clasp, to each of the sleeper bars. The opposite end of each safety line is attached to a harness that fits about the waist or body of a worker to secure the worker as he moves over the surface of the roof. The safety line enables the worker free movement in a relatively wide arc across the roof, with the range of movement of the worker being dependent on the length of the safety line.

To increase the range of movement of the workers over the roof structure, two or more pairs of sleeper bars can be placed along the peak of the roof, at spaced apart intervals. A hold bar is secured at its ends to the spaced apart sleeper bars and includes slide blocks that slide along the length of the hold bar. The safety lines for the workers can be attached to the slide blocks, which move along the length of the hold bar as the workers walk over the roof surface, thereby increasing the available range of movement of the workers about the roof surface while maintaining a safe distribution of forces.

DETAILED DESCRIPTION OF THE PREFERRED EMBODIMENTS

Figure 1:
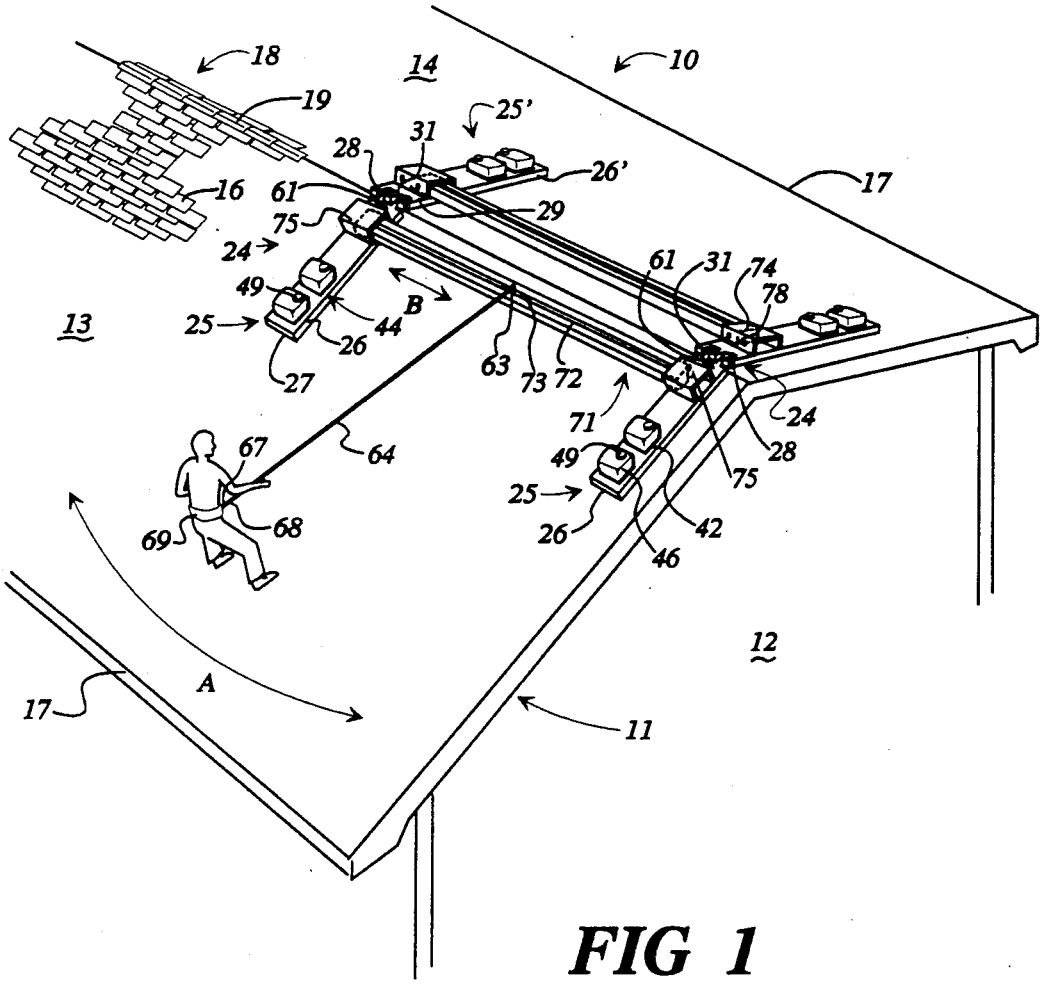
FIG. 1 is a perspective view of the safety device installed on a pitched roof.

Referring now in greater detail to the drawings in which like numerals indicate like parts throughout the several views, FIG. 1 illustrates in perspective the safety device 10 of the invention for roof work as mounted on a pitched roof 11 for a house or similar building structure 12. The roof 11 includes sloped roof surfaces 13 and 14, having a plurality of shingles 16 made from fiberglass, slate, tile, .or other suitable roofing material attached thereto. The sloped roof surfaces extend upwardly at opposite angles from eaves 17, which extend along the bottom edges of the sloped roof surfaces, meeting together to form a peak in the roof, indicated at 18. A roof cap 19 generally of the same roofing material as the shingles 16 is formed over the peak 18 of the roof, thereby covering it.

Figure 2:
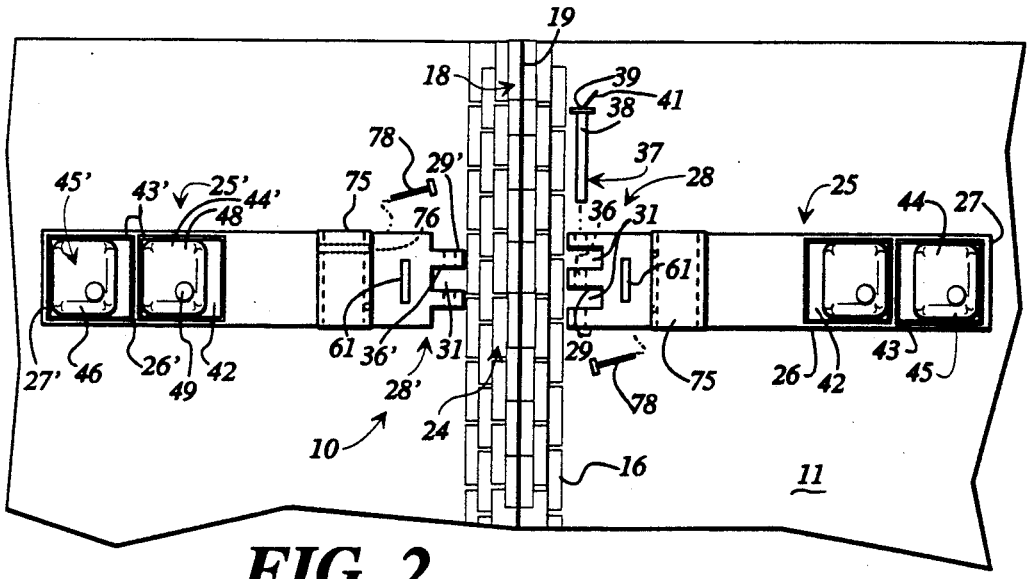
FIG. 2 is a plan view of a pair of interconnecting sleeper bars.
Figure 3:
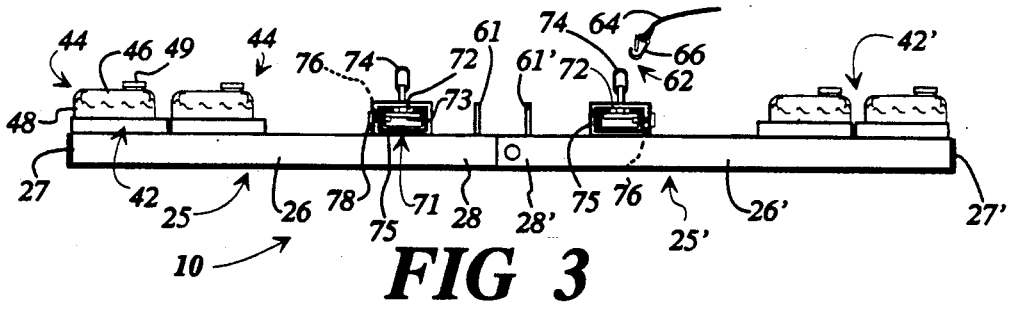
FIG. 3 is a side view of a sleeper bar with a hold bar latch thereon.

As illustrated in FIG. 1, the safety device for roof work 10 is positioned on the sloped roof surfaces 13 and 14, straddling the peak 18 of the roof 11. As shown in FIGS. 1, 2, and 3, the safety device for roof work 10 includes mating pairs 24 of sleeper bars 25 and 25' that interlock together. Each sleeper bar 25 and 25' is a generally rectangular beam or runner 26 and 26' of a length between approximately 30 and 36 inches and is approximately 4 inches wide and 1 - 1¼ inches in depth. The sleeper bars can be fabricated from a metal such as aluminum or can be constructed from a resilient, durable plastic such as a polyvinyl chloride material.

As shown in FIG. 2, each sleeper bar 25 and 25' includes a free end 27 and 27' and a notched end 28 and 28'. The notched ends 28 and 28' of the sleeper bars have a series of fingers or protrusions 29 and 29' spaced apart from each other to form slots 31 and 31' between the fingers. The slots 31 and 31' are sized to receive the fingers 29 and 29' of the sleeper bars and are aligned approximately with the fingers of mating sleeper bars. Sleeper bar 25 has three fingers, indicated by 29' and two slots 31, while sleeper bar 25' has two fingers 29 and three slots 31'. As indicated in FIG. 2, the two fingers 29' of sleeper bars 25' are received within the slots 31 of sleeper bars 25 and the three fingers 29 of sleeper bars 25 are received within the slots 31' of sleeper bars 25' to thereby cause the sleeper bars 25 and 25' to mate together to form an interlocking structure.

Connector pin openings 36 and 36' (shown in dashed lines) are formed through the fingers 29 and 29', and connector pins 37 are inserted therethrough to lock the sleeper bars together. The connector pins can be conventional locking pins having a shank 38 that extends through the connector pin openings 36, a head portion 39 at one end of the shank and a pull ring 41 attached to the head portion to enable the pins to be easily pulled from the connector pin openings. It will be understood, however, that the connector pins 37 can also be dowel pins or bolts sized to fit within the connector pin openings. The insertion of the connector pins 37 through the connector pin openings 36 and 36' of the pairs 24 of interlocked sleeper bars 25 creates a pivotal connection that enables the interlocked sleeper bars to pivot with respect to each other to increase or decrease the angle between them to match the pitch angle of the roof 11 (FIG. 1).

As shown in FIGS. 2 and 3, compartments 42 and 42' are formed along the length of the runners 26 and 26' of the sleeper bars 25 and 25'. Each sleeper bar typically has one to two compartments, which are generally square shaped open boxes having four side walls 43 and 43'. Each compartment 42 and 42' is sized to receive and hold a fluid container 44 within the space 45 and 45' defined by the side walls 43 and 43'.

Figure 4A:
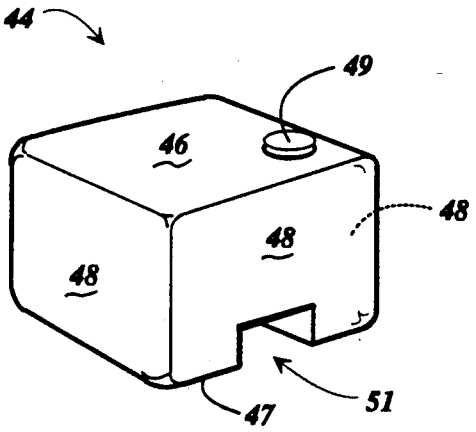
FIG. 4A is a perspective view of the bottom of a fluid container.
Figure 4B:
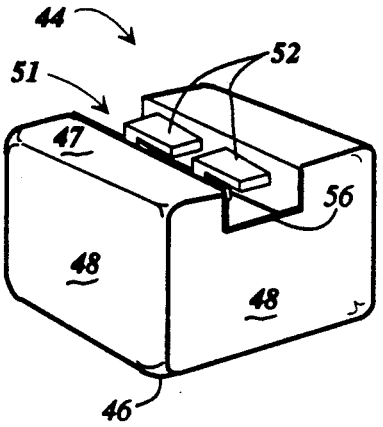
FIG. 4 is a perspective view of the top of a fluid container.

As shown in FIGS. 4A and 4B, each fluid container 44 is generally a square shaped box approximately twenty inches wide by twenty inches in length and six inches deep, sized to fit within the compartments. Although the containers shown are generally square shaped, it will be understood that containers of varied shapes can also be used. The containers are preferably formed from a durable plastic material that is lightweight and easy to handle, but is strong enough to hold the weight of fluid therein without rupturing. Each fluid container has a top surface 46, a bottom surface 47, and four sides 48. A filler hole 49 is mounted in the top surface 46 of each container 44 to enable the containers to be filled with a fluid medium such as water, sand, or even fine gravel which can be poured into and out of the fluid containers. The filler holes 49 are typically openings approximately four inches in diameter, to accommodate the nozzle end of a typical garden hose, having a screw type closure plug to seal them after filling with fluid. Each container holds approximately ten gallons of fluid and, when completely filled with fluid, weighs approximately 60 pounds.

Figure 5:
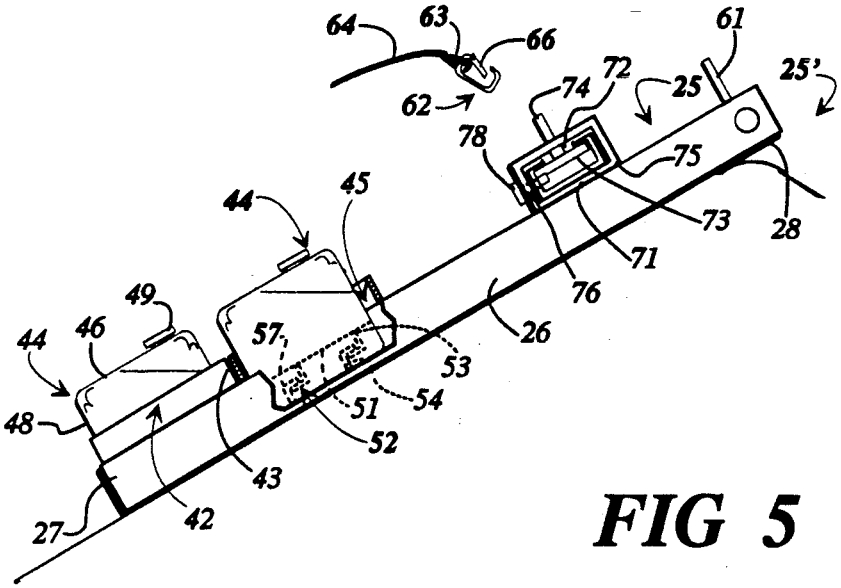
FIG. 5 a side view of a sleeper bar with a fluid container shown mounted thereon.

As illustrated in FIG. 4B, a recess 51 is formed in the bottom surface 47 of each container 44 approximately in the center thereof. The recesses 51 extend across the width of the container and have pairs of hooks or catches 52 mounted along their length. The catches 52 are typically L-shaped strips of plastic formed with the containers having one end 53 mounted to the bottom surfaces 47 of the containers and having a free end 54 spaced above the bottom surfaces of the containers with a gap 56 between the free end 54 of the catches 52 and the bottom surfaces 47 of the containers 44. As shown in FIG. 5, a second pair of catches 57 is mounted within each of the compartments 42 of the sleeper bars 25 and 25'. The catches 57 of the sleeper bars are positioned to receive and engage the catches 52 on the bottom surfaces of the containers to secure the containers within the compartments.

As illustrated in FIGS. 3 and 5, an eyebolt 61 and 61' is attached to each sleeper bar 25 and 25' adjacent the notched ends 28 and 28' thereof. A slip hook 62 is attached at one end 63 of a safety line 64 and is releasably attachable to each eyebolt to secure its safety line 64 to the sleeper bars. Each slip hook 62 is typically an oval shaped clasp having a spring biased section 66 that swings inwardly to open the clasp for engaging the eyebolts, similar to the safety clasps used by mountain climbers and persons who work on tall buildings. The safety lines 64 attached to the slip hooks are generally ropes made of nylon or other fibrous materials or are steel cables, which have sufficient strength and flexibility to support a worker without restricting his movement over the roof surfaces 13 and 14, as indicated in FIG. 1.

At the opposite end 67 (FIG. 1) of the safety lines 64 from the slip hooks 62 is a clasp 68 attached to a safety harness 69. The safety harness is typically a belt harness worn about the waist of a worker to secure him to the safety line and in turn to the sleeper bar, although it will be understood that other types of safety harnesses may be employed. Once so secured, the worker is able to safely and securely move about the sloped roof surfaces 13 and 14 with complete freedom of movement as illustrated by arrows A in FIG. 1.

Figure 6:
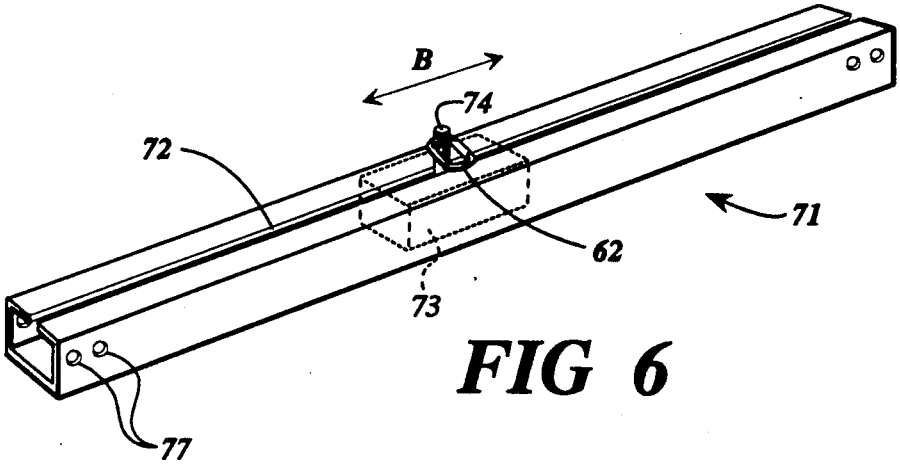
FIG. 6 is a perspective view of a hold bar.

As shown in FIG. 1, to increase the range of movement of a worker over the roof surfaces, additional interlocked pairs of sleeper bars 34 can be positioned on the roof 11 at spaced apart intervals. A hold bar 71 is mounted to each pair of sleeper bars, extending longitudinally parallel to and adjacent the peak 18 of the roof 11. As shown in FIG. 6, each hold bar 71 is a rectangular beam approximately 10 feet in length and approximately 1 inch in width and depth. A recess 72 is formed in each hold bar, extending the length of the hold bars. Slide blocks 73 are slidably mounted within the recesses 72 and are movable in the direction of arrows B along the length of the hold bars. Each slide block includes an eyebolt 74 attached thereto and to which the slip hook 62 of a safety line 64 can be releasably attached. Thus, as the workers walk along the roof surface, the slide blocks slide along the recesses 72, thereby expanding the area of the roof that can be covered by the workers.

As shown in FIGS. 2 and 3, a hold bar latch 75 is attached to each sleeper bar adjacent the eyebolts 61, positioned between the notched ends 28 and 28' and the uppermost compartment 42 of each sleeper bar to lock the ends of the hold bars to the sleeper bars 25 and 25'. As FIGS. 3 and 5 illustrate, each hold bar latch is a hollow rectangular box having lock pin openings 76 formed along one side (shown in dashed lines). As shown in FIG. 6, each hold bar 71 has a pair of circular lock pin openings 77 formed at each end and extending through the ends of the hold bars. To install the hold bars on the sleeper bars, the ends of the hold bars are inserted through one side of the hold bar latches 75 (FIG. 5) and the hold bar lock pin openings 77 are aligned with one of the lock pin openings 76 of the hold bar latches. Lock pins 78 are inserted laterally through the aligned lock pin openings 76 and 77 to lock the ends of the hold bars within the hold bar latches, thereby securing the ends of the hold bars to the sleeper bars 25. Additionally, another hold bar can be inserted into the opposite side of each hold bar latch and locked in place to further extend the range of movement of a worker.

Figure 7:
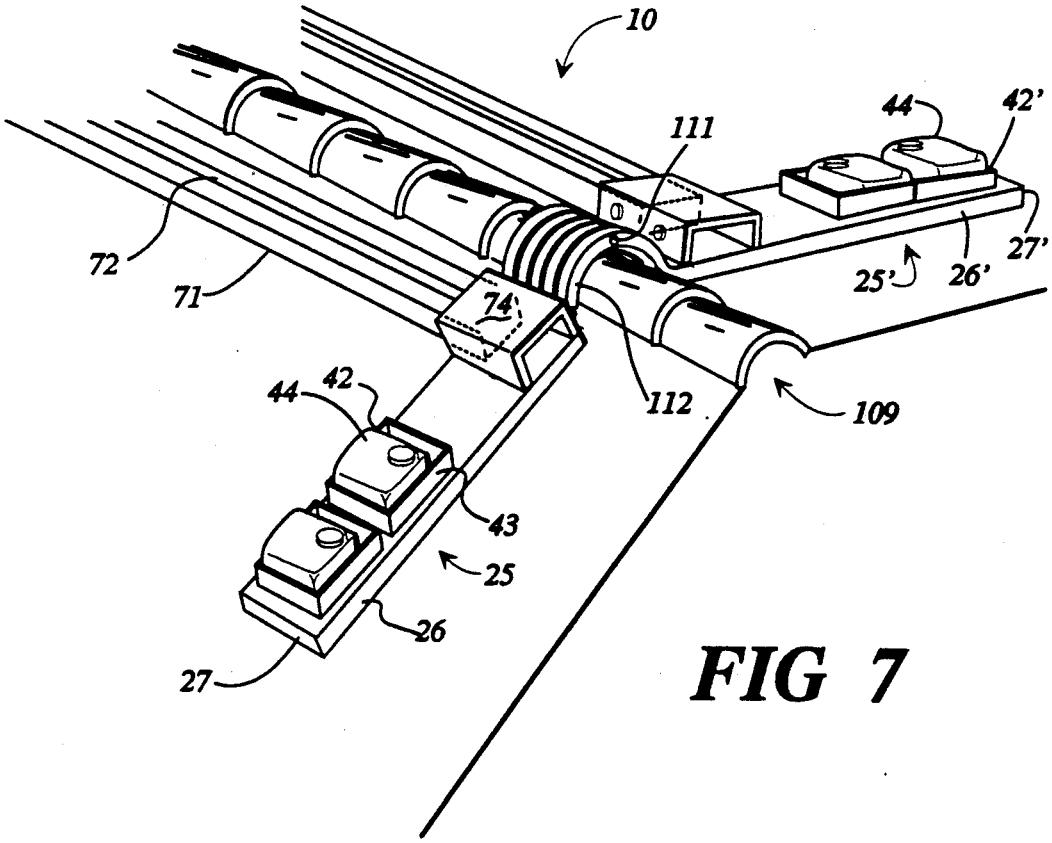
FIG. 7 is an end view of an alternate connection means for interlocking the sleeper bars.

FIG. 7 illustrates an alternate embodiment of the sleeper bars of the safety device for roof work 10, for use on terra-cotta or tile roofs 108 having a ridge vent or domed roof cap 109 constructed of tile or similar breakup material that is easily broken under high stress or weight. As illustrated in FIG. 7, the notched ends of the sleeper bars 25 and 25' are replaced with semicircular hooks 110. The hooks of one set of sleeper bars 25 and 25' include bolts or flanges 111 protruding outwardly from one side edge of the hooks, and the hooks for the mating sleeper bars have slots 112 formed therethrough which receive the flanges 111 of the hooks 110 of the opposing sleeper bars to secure the sleeper bars together in a mating relationship. As a result, the sleeper bars can be placed on opposite sides of the roof peak with the hooks extending over the roof cap 109, without the roof cap being engaged and without a pulling force being exerted on the roof cap by the sleeper bars. Thus, the risk of potentially damaging the roof cap is minimized.

OPERATION

In operation of the safety device 10 (FIG. 1) for roof work, a worker aligns the fingers 29 and 29' and slots 31 and 31' of an interlocking pair 24 of sleeper bars 25 and 25' and slides the sleeper bars together with the fingers 29 and 29' of the sleeper bars 25 and 25' meshing together. The worker then inserts a connector pin 37 through the aligned connector pin openings of the fingers of the sleeper bars to secure the sleeper bars together. After locking the sleeper bars together, the worker places the sleeper bars over the peak 18 of the roof 11, with the pivotal connection between the sleeper bars centered over the roof cap 19 and the sleeper bars lying flat against the sloped roof surfaces 13 and 14 without engaging or gripping the roof surfaces or the roof cap.

The worker then places a container 44 in each of the compartments 42 and 42' of each of the sleeper bars 25 and 25' and fills the containers with a fluid medium such as water by pouring the fluid through a hose or funnel through the inlet valve 49 of each container. Once the containers are filled, the worker caps the containers to seal the fluid within the containers. The worker then attaches the slip hook 62 at the end 63 of his safety line 64 to the eyebolt 61 for the sleeper bar resting on the sloped roof surface 13 or 14 on which he is working.

If the worker wants to increase the range of his movement about the roof surface 13 or 14, he installs a second pair of sleeper bars approximately 10 feet apart from the first pair previously installed on the roof surfaces. The worker then attaches a hold bar 71 between the two pairs of sleeper bars by fitting the ends of the hold bar 71 (FIGS. 1 and 3) into the hold bar latches 75 of sleeper bars 25 and inserting the lock pins 78 through lock pin openings 76 in the hold bar latches and lock pin openings 77 (FIG. 6) in the hold bars. Once the hold bar is attached between the two pairs of sleeper bars, the worker will attach the slip hook 62 (FIG. 3) at the end of his safety line to the eyebolt 74 of the slide block 73 for the hold bar 71 to secure himself to the hold bar.

As shown in FIG. 1, once the worker has been secured to either a single pair 24 of interlocked sleeper bars or to the slide block 73 of a hold bar 71 extending between the pairs of sleeper bars, he is now free to move about the sloped surfaces 13 or 14 of the roof 11 with minimal risk of slipping and falling off of the roof. Additionally, the placement of the sleeper bars on the sloped roof surfaces 13 and 14 without the use of hooks, angle irons, or similar grappling means to engage and pull on the peak of the roof enables the forces acting on the roof as a result of the weight of the worker, the roofing materials, and the safety device for roof work, to be evenly distributed over the roof surface thereby to minimize the stress forces acting on the cap and roof surfaces.

Figure 8:
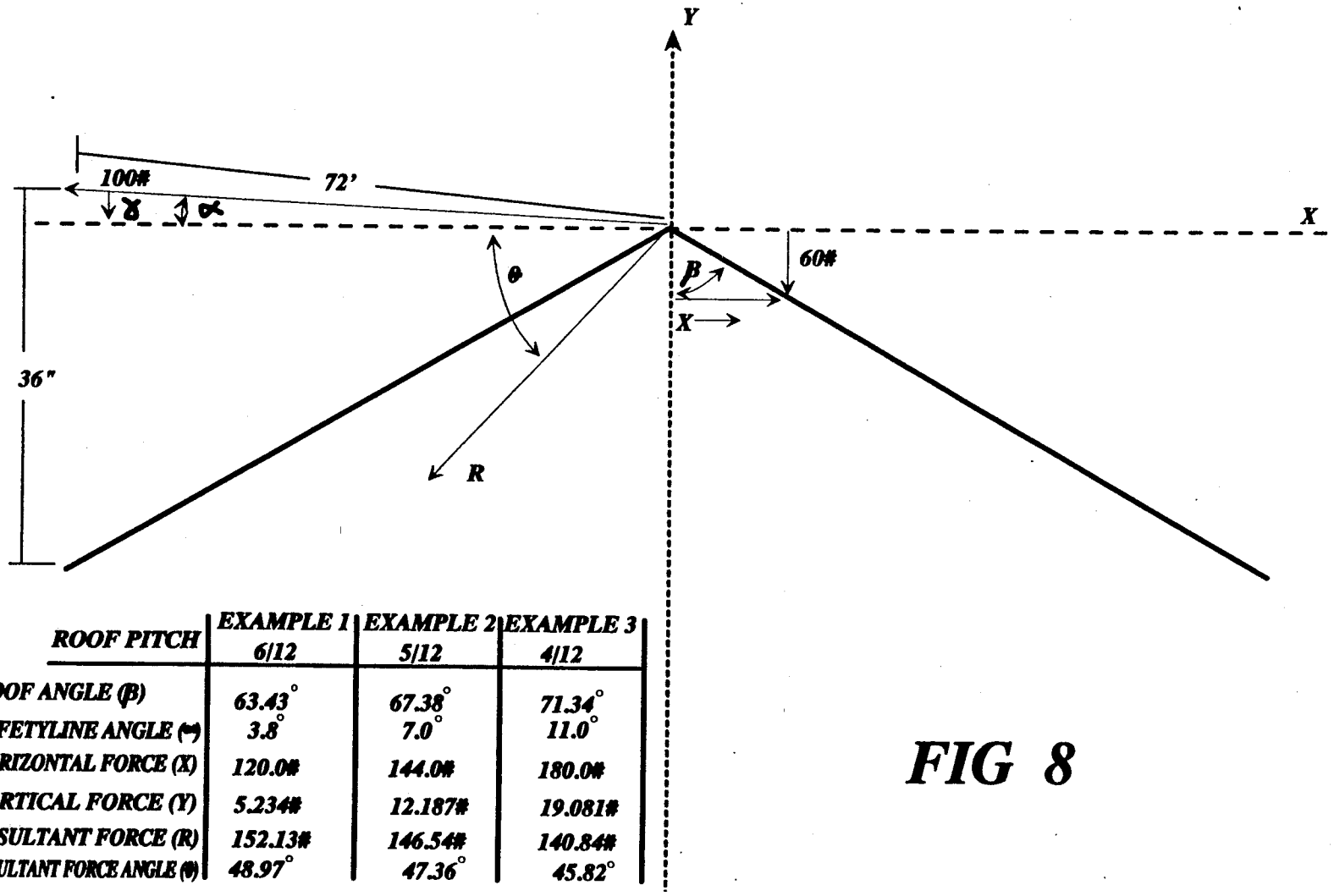
FIG. 8 is a force diagram illustrating the resultant forces ac on the roof under varying conditions.

FIG. 8 illustrates the resultant forces acting on the roof when using the safety device for roof work. Three common situations are summarized in the Table shown in FIG. 8, with the resultant forces indicated by "R", calculated for the use of the safety device for roof work on roofs of differing pitches. The calculations summarized in the Table of FIG. 8 are based upon two fluid filled containers weighing approximately sixty-pounds being positioned on the sleeper bars approximately 20 inches down the sloped roof surfaces from the peak of the roof, and taking a 200 pound worker standing six feet from the peak of the roof with the safety line attached about his waist approximately 36 inches above the sloped surface of the roof, with the worker exerting a force of approximately 100 pounds on the safety line. These calculations were made using a 6/12 roof pitch (example 1), a 5/12 roof pitch (example 2), and a 4/12 roof pitch (example 3), with the angle of the sloped roof surfaces for each of these roof pitches indicated by Beta (B) on the first line of the Table.

As indicated from the force diagram shown in FIG. 8, the resultant force R extends through the roof structure, below the roof line itself, indicating that the pulling force on the sleeper bars due to the weight of the worker as he moves about the roof surface is directed through the roof itself instead of across the peak of the roof. Thus, the movement of a worker across the roof is stabilized without risking damage to the roof structure itself. Consequently, the safety device can be positioned over the peak of a roof and will secure and stabilize the movements of a worker as he moves over the sloped surface of the roof, without engaging and pulling on the roof and possibly damaging the roof structure. The safety device thus provides a means for securing the worker that is easy to install and use and which minimizes the risk of damaging the roof.

While this invention has been specifically disclosed for working on the sloped surfaces of a pitched roof, it will be understood by those skilled in the art that this safety device can be utilized in other environments for supporting and securing a worker as he maneuvers about a sloped surface. Further, it will be understood that while sleeper bars have been disclosed as the preferred embodiment, a ladder or similar structure having openings between its rungs in which a compartment can be mounted can be used in place of the sleeper bars. Additionally, while the sleeper bars and hold bars have been disclosed in specific dimensions, it will be understood that other dimensions of these elements can be used as may be desirable for other applications.

It will be understood that the foregoing relates only to a preferred embodiment of the invention. It should be understood by those skilled in the art that numerous changes and modifications can be made to the described embodiments of the invention without departure from the spirit and scope of the invention.

What is claimed is:

1. Safety support apparatus for supporting a worker on a pitched roof having a pair of sloped roof surfaces terminating at a peak, said apparatus comprising a plurality of elongated sleeper bars adapted to be interlocked together and to be positioned straddling the peak of the roof;

at least one stabilizing means adapted to be mounted on each of said sleeper bars for exerting a downward force to stabilize and maintain said sleeper bars adjacent the surface of the roof;

means attached to each of said sleeper bars for detachably mounting said stabilizing means on said sleeper bars and adapted to engage and lock said stabilizing means to said sleeper bars; and a restraining line adapted to be releasably attached to one end to said sleeper bars and at its other end to a harness worn by a worker for restraining the movement of the worker over the surface of the roof.

2. The safety support apparatus of claim 1 and wherein each of said sleeper bars comprises a rectangularly shaped runner having a plurality of compartments formed along its length for receiving and holding said stabilizing means and a notched end portion formed at one end of each of said runners for mating with a notched end portion of the runner of another one of said sleeper bars to lock said sleeper bars in series.

3. The safety support apparatus of claim 2 and wherein each of said stabilizing means comprises a container sized to fit within said compartments of said sleeper bars and filled with a fluid medium.

4. The safety support apparatus of claim 2 and wherein said means for detachably mounting each of said stabilizing means on said sleeper bars comprises a first set of hooks attached to said runners and positioned within said compartments, and a second set of hooks attached to one side of each of said stabilizer means for engaging said first set of hooks attached to said sleeper bars to attach each of said stabilizer means to said sleeper bars.

5. Safety assembly for working on sloped surfaces such as the surface of a pitched roof, comprising a plurality of interlocked sleeper bars pivotably attachable in pairs so as to enable said sleeper bars to pivot with respect to one another, at least one pair of attached sleeper bars being spaced from a second attached pair of sleeper bars;

means for stabilizing said sleeper bars on the sloped surfaces mounted to each of said sleeper bars;

hold bars having first and second ends extending between and attached at said first and second ends to spaced pairs of said interlocked sleeper bars, each of said hold bars having a recess formed along its length between said ends of said hold bars and at least one slide block slidably mounted within said recess of each of said hold bars; and a restraining means attached at one end to a harness adapted to be worn by a worker and releasably attached at its opposite end to one of said slide blocks for restraining and supporting the worker during movement over the sloped surfaces.

6. The safety assembly of claim 5 and wherein said means for stabilizing said sleeper bars against the sloped surfaces comprises a plurality of fluid containers releasably mounted to each of said sleeper bars and having inlet openings for enabling each of said fluid containers to be filled with a fluid medium.

7. The safety assembly of claim 5 and wherein each of said sleeper bars includes a rectangularly shaped runner having a series of compartments formed along its length for receiving and holding said hold down means and a notched end portion formed at one end of said runner for mating with a notched end portion of a runner of another one of said sleeper bars to lock said sleeper bars in series.

8. A safety support apparatus for supporting a worker on a pitched roof having a pair of sloped surfaces of opposing angles, which meet together to form a peak, comprising:

a first pair of interlocked sleeper bars straddling the peak of the roof, with each of said sleeper bars positioned on one of the sloped surfaces of the roof;

fluid containers releasably attached to each of said sleeper bars and fillable with a fluid medium for stabilizing and securing said sleeper bars to the sloped surfaces of the roof;

compartments formed at spaced apart intervals along the length of each of said sleeper bars, adapted to receive and hold said fluid containers; and a restraining line releasably attachable to each of said sleeper bars at one end and adapted to be attached to a worker at its other end to secure the worker as he moves about the sloped surfaces of the roof in an accurate range of movement.

9. The safety support apparatus of claim 8 and further including a second pair of interlocked sleeper bars positioned on the sloped surfaces of the roof spaced from said first pair of interlocked sleeper bars, and at least one hold bar extending between one of the sleeper bars of said first pair and a corresponding one of said sleeper bars of said second pair and having one end attached to said one sleeper bar of said first pair of sleeper bars and another end attached to said corresponding sleeper bar of second pair of sleeper bars, recesses formed along the length of said hold bars and slide blocks mounted within and adapted to slide along said recesses and to which said restraining lines are releasably attachable to thereby increase the range of movement of the worker over the sloped surfaces of the roof.

10. The safety support apparatus of claim 8 and further including a first notched end formed at one end of one of said sleeper bars of said first pair of interlocked sleeper bars and having a plurality of protrusions with a series of slots formed therebetween, a second notched end found at one end of said other one of said first pair of interlocked sleeper bars and having a plurality of protrusions with a series of slots formed therebetween, with said protrusions of each of said notched ends adapted to engage said slots between said protrusions in mating engagement and a connector pin inserted through said protrusions to lock and hold said sleeper bars in an interlocking relationship.

* * * * *